US005955251A

United States Patent [19]

Koyama et al.

[11] Patent Number: 5,955,251

[45] Date of Patent: Sep. 21, 1999

[54] METHOD FOR PRODUCING INFORMATION RECORDING MEDIUM

[75] Inventors: Hirokazu Koyama; Makoto Honda; Toshiaki Shibue, all of Hino, Japan

[73] Assignee: Konica Corporation, Tokyo, Japan

[21] Appl. No.: 09/060,597

[22] Filed: Apr. 15, 1998

[30] Foreign Application Priority Data

Apr. 21, 1997 [JP] Japan ..... 9-103204

[51] Int. Cl.[6] ..... G03C 1/795; G03C 1/93; G03C 1/74; G03C 11/22

[52] U.S. Cl. ..... 430/532; 430/534; 430/533; 430/536; 430/140; 430/623; 430/935; 427/314; 427/316; 427/532; 427/533; 427/553

[58] Field of Search ..... 430/532, 534, 430/623, 533, 536, 935, 140; 427/532, 533, 553, 314, 316

[56] References Cited

U.S. PATENT DOCUMENTS

| | | | |
|---|---|---|---|
| 4,241,169 | 12/1980 | Work et al. | 430/532 |
| 5,618,659 | 4/1997 | Grace et al. | 430/532 |

FOREIGN PATENT DOCUMENTS

| | | |
|---|---|---|
| 2-60941 | 3/1990 | Japan . |
| 2-99537 | 4/1990 | Japan . |
| 4-181244 | 6/1992 | Japan . |
| 5-295275 | 11/1993 | Japan . |
| 6-293838 | 10/1994 | Japan . |
| 6-293839 | 10/1994 | Japan . |
| 7-242758 | 9/1995 | Japan . |

*Primary Examiner*—Richard L. Schilling
*Attorney, Agent, or Firm*—Frishauf, Holtz, Goodman, Langer & Chick, P.C.

[57] ABSTRACT

A method for producing an information recording medium is disclosed. The method comprising the steps of (1) applying a surface treatment on a surface of a film support so that the atomic percentage of oxygen at said surface is increased by 1.0 atomic-% to 10 atomic-% compared to the atomic percentage of oxygen at said surface before treatment, (2) providing a subbing layer comprising a water-soluble or water-dispersible polymer having a 2-oxazoline group represented by Formula A on said treated surface of the film support so that the subbing layer is directly adjoined to said surface, and (3) providing an information recording layer on said subbing layer, Formula A

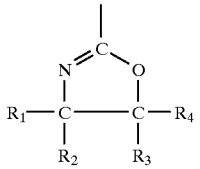

wherein $R_1$, $R_2$, $R_3$ and $R_4$ are each independently a hydrogen atom, a halogen atom, an alkyl group, an aralkyl group, a phenyl group.

16 Claims, No Drawings

METHOD FOR PRODUCING INFORMATION RECORDING MEDIUM

FIELD OF THE INVENTION

This invention relates to a method for producing an information recording medium, particularly related to a method for producing an information recording medium such as a silver halide photographic light-sensitive material or a magnetic recording medium excellent in the adhesiveness between the support and the layer adjoining to the support. The recording medium has a high resistivity against damage formed at the time before, during and after the photographic processing, and at the time of passing the magnetic layer on a magnetic head.

BACKGROUND OF THE INVENTION

When a scratch is formed on a photographic film, an unnecessary line is formed in the photographic image and commercial value of the photograph is lost. Recently, therefore, the prevention of the scratch by increasing the strength of each layer constituting the photographic film is tried. However, the layer is peeled at the interface between the layer adjoining to the support and the support and a scratch like peeling of the layer is formed when the adhesiveness between the layers or the layer and the support is insufficient even if the strength of the layer is sufficient. Particularly, the sufficient adhesiveness between a hydrophobic polyester support and the layer adjoining to the support is difficultly attained.

As the technology for raising the adhesiveness of the support with the adjoining layer, many methods have been known which include a method of pretreatment such as glow discharge treatment, a method by addition of a cross-linking agent to the layer adjoining to the support, and the combination of such the methods. Concrete examples of the cross-linking agent include epoxy compounds described in Japanese Patent Publication Open for Public Inspection (JP O.P.I.) No. 51-103422, and triazine compounds described in JP O.P.I. No. 51-114120.

JP O.P.I. Nos. 2-60941, 2-99537, 4-181244, 5-295275, 6-293838, 6-293839, and 7-242758, each discloses a subbing layer containing an oxazoline compound for giving an adhesiveness to a support such as a polyester film. However, the technology disclosed in these publications intends to raise the strength of the layer by reaction of a carboxyl group of the binder of the adjoining layer and the oxazoline, and no surface treatment is a premise of the technology. Accordingly, this technology is different from that of the present invention. The sufficient adhesiveness between the support and the layer adjoining to the support cannot be obtained by these technology. Particularly, the adhesiveness is insufficient for the information recording medium to be processed by an alkaline or acidic solution such as the processing solution for photographic material. A larger adhesiveness is required to prevent a damage by scratch or peeling of the layer during or after processing.

Recently, the scratch tends to be frequently formed since the speed of the production, preparation before processing, processing and print processing are raised. Consequently, the adhesiveness between the support and the layer adjoining to the support according to the usual technique becomes insufficient.

Moreover, in the magnetic recording medium, a scratch is formed when the recording medium is passed on a magnetic head for writing or reading out of information, which causes a fatal defect on the magnetic recording if the adhesiveness between the support and the layer adjoining to the support is insufficient. Recently, a silver halide photographic light-sensitive material having a transparent magnetic recording layer on the back side thereof is proposed such as described in U.S. Pat. Nos. 3,782,947, 4,279,945, and 4,302,523. It is necessary that the magnetic recording medium having the silver halide light-sensitive layer maintains the sufficient adhesiveness after processing. Such the adhesiveness hardly obtained by the usual technology.

SUMMARY OF THE INVENTION

The object of the invention is to provide a method for producing an information recording medium excellent in the adhesiveness between the support and the layer adjoining to the support. The second object of the invention is to provide a method for producing an information recording medium having a high resistivity to a damage formed before, during and after a photographic processing, or to a damage formed by passing on a magnetic head.

The above-mentioned object of the invention can be achieved by a method for producing an information recording medium comprising the steps of applying a surface treatment on a surface of a support film so that the atomic percentage of oxygen atom at said surface is increased by 1.0 atomic-% to 10 atomic-% of the number of oxygen atom at said surface before said surface treatment, providing a subbing layer comprising a water-soluble or water-dispersible polymer having a 2-oxazoline group represented by Formula A, on said treated surface of the support film so that the subbing layer is directly adjoined to said support, and providing an information recording layer on said subbing layer, Formula A

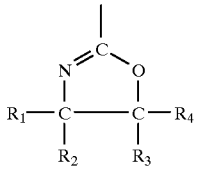

wherein $R_1$, $R_2$, $R_3$ and $R_4$ are each independently a hydrogen atom, a halogen atom, an alkyl group, an aralkyl group or a phenyl group.

DETAIL DESCRIPTION OF THE INVENTION

In the invention, an unexpectable high adhesiveness can be obtained by combining the oxazoline compound and the surface treatment. Although the detailed mechanism of such the effect is not clear, it is assumed that the reactivity of an oxygen-containing group formed by the surface treatment on the support surface has very high reactivity with the oxazoline group and the high adhesiveness is formed by formation of direct cross linking between the support and the layer adjoining to the support.

The water-soluble polymer having a 2-oxazoline group according to the invention is a water-soluble polymer having a 2-oxazoline represented by the following Formula A as a pendant.

Formula A

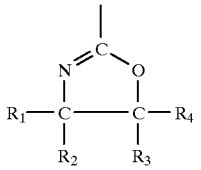

In the formula, $R_1$, $R_2$, $R_3$ and $R_4$ are each independently a hydrogen atom, a halogen atom, an alkyl group, an aralkyl group or a phenyl group. The phenyl group may have a substituent. Concrete examples are as follows.

| No. | $R_1$ | $R_2$ | $R_3$ | $R_4$ |
|---|---|---|---|---|
| 1 | H | H | H | H |
| 2 | —$CH_3$ | H | H | H |
| 3 | H | H | —$CH_3$ | H |
| 4 | H | H | —$CH_3$ | H |
| 5 | —$CH(CH_3)_2$ | H | H | H |
| 6 | Cl | H | H | H |
| 7 | Cl | Cl | H | H |
| 8 | Cl | H | Cl | H |

As a concrete example of water-soluble polymer, Polymer B described in JO O.P.I. No. 5-295275 is cited. In concrete, the polymer can be synthesized by solution polymerization of a monomer having a 2-oxazoline group such as 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline or 2isopropenyl-4-methyl-2-oxazoline, and optionally another kind of monomer, in an aqueous medium according to a known polymerization method. The monomer having the 2-oxazoline group preferably accounts for not less than 3% by weight, more preferably form 5% to 100% by weight, poarticularly preferably from 10% to 80% by weight of the total of the monomer to be polymerized. The followings are usable as the above-mentioned the other monomer: an acrylate, a methacrylate or α-chloro-acrylate such as methyl acrylate, ethyl acrylate, n- or i-propyl acrylate, n-, i- or t-butyl acrylate, 2-hydroxyethyl acrylate, cyclohexyl acrylate, benzyl acrylate, ethylene glycol diacrylate, propylene glycol diacrylate, polyethylene glycol acrylate, α-chloromethyl acrylate, α-chloroethyl acrylate, methyl methacrylate, ethyl methacrylate, n- or i-propyl methacrylate, n-, i- or t-butyl acrylate, 2-hydroxyethyl methacrylate, cyclohexyl methacrylate, benzyl methacrylate, ethylene glycol dimethacrylate, propylene glycol dimethacrylate or, polyethylene glycol methacrylate; a vinyl ether such as methyl vinyl ether, ethyl vinyl ether, benzyl vinyl ether, or cyclohexyl vinyl ether; a vinyl ester such as vinyl acetate, vinyl propionate or vinyl benzoate; a vinyl ketone such as ethyl vinyl ketone, or cyclohexyl vinyl ketone; a styrene compound such as styrene, methylstyrene, chlorostyrene, or divinylbenzene; an acrylamide such as acrylamide, methacrylamide, or dimethylacrylamide, n-, i- or t-dibutylacrylamide; and s chloroolefin such as vinyl chloride or vinylidene chloride. For giving a water-solubility, it is preferable that a hydrophilic monomer accounts for not less than 50 mole-% of the monomer constituting the polymer. Example of such the hydrophilic polymer include the monomer having a 2-oxazoline group and another monomer such as 2-hydroxyethyl acrylate, methoxy polyethylene glycol acrylate, 2-animatedly acrylate and its salt, acrylamide, N-methylacrylamide, N-(2-hydroxyethyl)-acrylamide, acrylonitryl, 2-hydroxyethyl methacrylate, methoxy polyethylene glycol methacrylate, aminoethyl methacrylate and its salt, methacrylamide, N-methylolmethacryamide, N-(2-hydroxyethyl)-methacrylamide, methacrylonitryl and sodium styrene-sulfonate. Concrete examples of the polymer are as follows:

W-1: Poly(2-isopropenyl-2-oxazoline) in a mole ratio of 100.

W-2: Copolymer of 2-vinyl-2-oxazoline/ethyl acrylate in a mole ratio of 70/30

W-3: Copolymer of 2-isopropenyl-2-oxazoline/2-hydroxethyl methacrylate/n-butyl methacrylate in a mole ratio of 60/20/20

W-4: Copolymer of 2-vinyl-5-methyl-2-oxazoline/acrylamide in a mole ratio of 80/20

Epocros WS-500 and WS-300, manufactured by Nippon Syokubai Co., Ltd., are usable, which are water-soluble polymer ech having a 2-oxazoline group and available on the market.

The 2-oxazoline group-containing water-dispersible polymer according to the invention is a water-dispersible polymer having a 2-oxazoline group represented by the foregoing Formula A such as that example of the polymer include Polymer B described in JP O.P.I. No. 2-99537. The water-dispersible polymer can be synthesized by polymerization of a monomer as above-mentioned and optionally another monomer as above-mentioned by a known emulsion polymerization method or an emulsion polymerization method for forming a core/shell structure. The monomer having the 2-oxazoline group preferably accounts for not less than 3% by weight, more preferably form 5% to 100% by weight, poarticularly preferably from 10% to 80% by weight of the total of the monomers to be polymerized. The synthesis can be performed according to the method described in W. R. Sorenson & T. W. Cambell "Experimental Method for Synthesis of High Molecular Substance" (translated by Hoshino & Ida, published by Tokyo Kagaku Dojin) The emulsion polymerization for constituting a core/shell structure can be performed by the method described in JP O.P.I. No. 8-286301. Concrete examples of such the water-dispersible polymer include the followings:

P-1: Copolymer of 2-isopropenyl-2-oxazoline/styrene/ethyl acrylate in a mole ratio of 30/40/30

P-2: Copolymer of 2-vinyl-2-oxazoline/methyl methacrylate/cyclohexyl methacrylate in a mole ratio of 40/40/20

P-3: Copolymer of 2-isopropenyl-4-methyl-2-oxazoline/n-butyl acrylate/styrene in a mole ratio of 30/35/35

P-4: Copolymer of 2-isopropenyl-2-oxazoline/n-butyl acrylate/styrene/divinylbenzene in a mole ratio of 30/30/30/10

Epocros K-1010E, K-1020E, K-1030E, K-2010E, K-2020E and K-2030E, manufactured by Nippon Syokubai Co., Ltd., are also usable which are water-dispersible polymers each having a 2-oxazoline and available on the market.

The foregoing water-soluble or water-dispersible polymer has a cross-linking agent ability to another polymer and is usable as a cross-linking agent in the subbing layer according to the invention.

The polyester support usable in the invention is described below. The polyester support usable in the invention is composed of a polyester constituted by a dicarboxylic acid component and a diol component.

The dicarboxylic acid component as the principal constituting component of the polyester includes terephthalic acid, iso-phthalic acid, phthalic acid, 2,6-naphthalene-dicarboxylic acid, 2,7-naphthalene-dicarboxylic acid, diphenylsulfondicarboxylic acid, diphenyletherdicarboxylic acid, diphenylethanedicarboxylic acid, cyclohexanedicarboxylic acid, diphenyldicarboxylic acid, diphenylthioetherdicarboxylic acid, diphenylketonedicarboxylic acid, and phenylindanedicarboxylic acid. The diol component includes ethylene glycol, propylene glycol, tetramethylene glycol, cyclohexanedimethanol, 2,2-bis(4-hydroxyphenyl)propane, 2,2-bis(4-hydroxyethoxyphenyl)propane, bis(4-hydroxyphenyl)sulfone 9,9-bis(4,4'-di-β-hydroxyethyl) fluorene, diethylene glycol, neopentyl glycol, hydroquinone and cyclohexanediol.

Among the polyesters composed of the foregoing components, a polyester principally composed of terephthalic acid and/or 2.6-naphthalenedicarboxylic acid as the dicarboxylic acid and ethylene glycol and/or 1,4-cyclohexanedimethanol as the diol component is preferred from the view point of the transparency, mechanical strength and dimension stability of the support. A polyester containing polyethylene terephthalate unit or polyethylene 2,6-naphthalate unit is preferable. A film excellent in the transparency, mechanical strength and dimension stability is obtained when the polyester contains ethylene terephthalate unit or a ethylene 2,6-naphthalate unit in an amount of not less than 70% by weight.

Another copolymer component may be copolymerized or another kind of polyester may be mixed with the polyester constituting the polyester film usable in the invention as long as the effect of the invention is hindered. As example of such the component, the foregoing dicarboxylic acid component, diol component and polyester are cited.

It is preferable to add a dye into the polyester to be used in the invention to prevent the light piping phenomenon. Although there is no limitation on the kind of dye to be added to the polyester, a dye excellent in the heat resistivity such as an anthraquinone dye or a perinone dye is required to suit for the production process of the film. The tint of the film is preferably gray such as the tint of usual photographic film.

Although there is no limitation on the thickness of the polyester film, a thickness of from 20 to 125 μm, particularly of from 40 to 90 μm, is preferred.

The haze of the polyester film is preferably not more than 3%, more preferably not more than 1%. When a film having a haze of more than 3% is used as the support of photographic light-sensitive material, an image printed on a photographic paper is become blurry and unclear. The haze is measured according to ASTM-D1003-52.

The glass transition point Tg of the polyester film usable in the invention is preferably within the range of from 70° C. to 150° C. The Tg can be measured by a difference scanning calorimeter. When the Tg is within this range, a light-sensitive material having no deformation during the drying process of the processor and a small roll set curling can be obtained.

Although the production process of the polyester film usable in the invention is described below, the production method of the film is not limited thereto. The method for producing a non-stretched sheet and that for mono-axis stretching the film to the lengthwise direction are carried out according to known methods. For example, raw polyester is formed in a pellet form, and dried by hot air or in a vacuum. The pellets are molten and extruded from a T-die in a sheet form and contacted on a cooling drum by applying an electrostatic charge and solidified by cooling to form a non-stretched sheet. The sheet is lengthwise stretched by single or multi steps through plural roller groups and/or a heating means such as an infrared ray heater for heating the film within the range of from the Tg to Tg+100° C. of the polyester. The stretching ratio is usually within the range of from 2.5 to 6, and the ratio has to be set within the range in which the widthwise stretching to be performed after the lengthwise stretching is possible.

The lengthwise mono-axis stretched polyester film prepared as above-mentioned is widthwise stretched within the temperature range of from the Tg to Tm−20° C. (Tm: melting point) of the polyester, and thermally fixed. The widthwise stretching ratio is usually from 3 to 6, and the ratio of the lengthwise and widthwise stretching ratio is optionally controlled to obtain a desired property according to the measurement of physical properties of the bi-axis stretched film. Generally, the properties of the lengthwise direction and widthwise direction of the film is preferably to be balanced, but they may be different from each other according to the suing purpose of the film. In the widthwise stretching process, it is preferred that the film is stretched in two or more separated stretching zones while stepwise raising the temperature with the difference range of from 1° to 50° C. The deviation of the physical properties in the widthwise direction can be reduced by such the operation. It is preferred to maintain the temperature of the film after widthwise stretching within the range of from Tg to Tg−40° C. for a time of from 0.01 to 5 minutes for further reducing the deviation of the physical properties of the film in the widthwise direction.

The film is thermally fixed a temperature not lower than the final stretching temperature and not higher than Tm−20° C. for a time of from 0.5 to 300 seconds. In the thermal fixing process, it is preferred that the film is fixed in two or more separated fixing zones while stepwise raising the temperature with the difference range of from 1° to 100° C.

The thermally fixed film is usually cooled by a temperature lower than the Tg and wound up after cutting off the clipped portion on the both side edges of the film. It is preferable at this time that the film is subjected to a treatment for slacking of 0.1 to 10% in the direction of the widthwise and/or lengthwise at a temperature of not higher than the thermal fixing temperature and not lower than the Tg. The optimal conditions of the thermal fixing, cooling and slacking are different according to the polyester constituting the film. Accordingly, theses conditions may properly be controlled to obtained desired physical properties.

Various means can be applied to reduce the roo set curl of the polyester film. For example, JP O.P.I. No. 51-16358 discloses a method win which the polyester film is thermally treated at a temperature of 30° C. to 5° C. lower than the glass transition point Tg thereof. JP O.P.I. No. 1-131550 describes a method for giving a permanent curling to the film in which a temperature gradient between the surface side and reverse side of the film is given between the lengthwise stretching process and the widthwise stretching process to make a difference of crystallization and orientation in the film. Moreover, a method for canceling out the curling by the curling formed during storage of the product by winding up the product in the reversed direction, and a method in which a polyester film stretched at a different temperature is thermally treated at a temperature of from nor higher than the Tg to a temperature not lower than 50° C., have been known. Polyester having a glass transition point of from 90° C. to 200° C. is preferable for the support which can be reduced in the curling caused by winding up by the thermal treatment, since the effect of the thermal treatment is lost when the film is exposed to a temperature higher than the glass transition point. The polyester having a glass transition point of not less than 90° C. is preferable based on the highest temperature given the film in the condition of the use by a customer. The temperature in a car in summer possibly come up by 80° C. or more. Besides, a polyester film having a transparency and a glass transition point of not higher than 200 k C is not exist at the present day.

A support principally composed of polyethylene terephthalate or polyethylene naphthalate is particularly preferred. Such the support is a film composed of polyethylene terephthalate, polyethylene naphthalate or a copolymer thereof, or a film composed of a composition made from these materials. The support is preferably subjected to a thermal fixing treatment after a bi-axis stretching. and may be subjected to a thermal slacking treatment according to necessity.

In such the case, it is preferable that the heating treatment is carried out at a temperature of from 50° C. to the glass transition point thereof for a time of from 0.1 hour to 1500 hours. For example, in the case of polyethylene naphthalate, the Tg is about 120° C. Therefore, the heating treatment is preferably carried out at a temperature of not higher than 119° C. for a time of from 0.2 hours to 72 hours, more preferably at a temperature of not higher than 115° C. for about 24 hours. For shortening the treating time, It is particularly preferred, that the temperature is once raised by a temperature higher than the Tg and gradually cooled near the temperature of Tg. The heating treatment can be carried out with a very high efficiency by such the procedure. In the case of polyethylene naphthalate, for example, the time for heating treatment can be considerably shortened by maintaining once the temperature of the film at a temperature of from 130° C. to 200° C. and then cooling by 125° C., and gradually cooled by 100° C. When the heat absorption of the support is measured by a differential calorimeter, a heat absorption peak appears near the Tg of the film. The roll set curl is difficultly formed in the support having a lager heat absorption peak. It is preferable that the film is treated so that the heat absorption at the peak is 100 mcal/g, more preferably 200 mcal/g.

As the surface treatment according to the invention, a corona discharge treatment, a glow discharge treatment, an ultraviolet irradiation treatment. a flame treatment, a high frequency wave treatment, an active plasma treatment, and a laser treatment are usable. Among them, the corona discharge treatment, the glow discharge treatment, the ultraviolet irradiation treatment and the flame treatment are preferred.

The corona discharge treatment is the most usual method which can be carried out by methods described in, for example, JP O.P.I. Nos. 48-5043, 47-51905, 74-28067, 49-83769, 51-41770 and 51-131576.

An adequate discharge frequency of the corona discharge treatment is preferably from 50 Hz to 5000 kHz, preferably from 5 kHz to several hundreds kHz. A frequency too low is not preferred since a stable discharge is difficultly performed and pinholes are formed on the subject of the treatment. On the other hand, a specific apparatus for impedance matching with a high cost is necessary when the frequency is too high. An intensity of the treatment to be given to the subject is preferably from 0.001 kV.A.min./$m^2$ to 5 kV.A.min. /$m^2$, more preferably from 0.01 kV.A.min./$m^2$ to 1 kV.A.min. /$m^2$. The gap clearance between the electrode and the dielectric roller is preferably from 0.5 to 2.5 mm, preferably from 1.0 to 2.0 mm.

The glow discharge treatment which is the most effective treatment is frequently carried out by known methods, for example, those described in JP O.P.I. Nos. 35-7578, 53-129262, 36-10336, 45-22004, 45-22005, 45-24040, and 46-43480, U.S. Pat. Nos. 3,057,792, 3,057,795, 3,179,482, 3,288,638, 3,309,299, 3,424,735, 3,462,335, 3,475,307, and 3,761,299, and BP No. 997093.

As the glow discharge treatment condition, the pressure is usually from 0.005 to 20 Torr, preferably 0.02 to 2 Torr. The effect of the treatment is lowered when the pressure is too low, and when the pressure is too high, an excessive electric current is generated and sparks tend to be occurred. The spark is dangerous and probably causes a destruction of the object. The discharge is occurred by applying a high voltage between one or more pairs of metal plates or metal rods arranged in a vacuum cabinet. A stable discharge is usually occurred by a voltage of from 500 to 5000V within the above-mentioned range of the pressure even though the voltage may be various values depending on the composition of the gas of the atmosphere and the pressure thereof. The particularly preferable voltage range for raising the adhesiveness is from 2000 to 4000V. The frequency of discharge is from a direct current to several thousands MHz, preferably from 50 Hz to 20 MHz, as shown in a technical publication. The intensity of discharge is preferably 0.01 KV.A.min./$m^2$ to 5 kV.A.min./$m^2$, more preferably from 0.15 KV.A.min./$m^2$ to 1 KV.A.min./$m^2$.

The ultraviolet treatment can be carried out by the methods described in, for example, JP O.P.I. Nos. 43-2603, 43-2604 and 45-3828.

Irradiating light having a principal wavelength of 365 nm irradiated from a high pressure mercury lamp may be used for ultraviolet treatment if raising the temperature by approximate 150° C. does not cause any problem on the properties of the support. When the treatment under a low temperature condition, a low pressure mercury lamp irradiating light having a principal wavelength of 254 nm. A ozoneless type high or low pressure mercury lamp is also usable. Although the adhesiveness is raised accompanied with increasing the light amount for treating, a problem of increasing the brittleness of the support is raised. Consequently, For usual polyester, the irradiation light amount is preferably from 20 to 10000 mJ/$cm^2$, more preferably from 50 to 2000 mJ/$cm^2$, when the high pressure mercury lamp irradiating light having a principal wavelength of 365 nm is used as the light source. When the low pressure mercury lamp irradiating light having a principal wavelength of 254 nm is used, the light amount is preferably from 100 to 10000 mJ/$cm^2$, more preferably from 300 to 1500 mJ/$cm^2$.

Natural gas, liquidized propane gas and city gas are usable for the flame treatment according to the invention, and the mixing ratio of the gas and air is important. It is considered that the effects of the flame treatment is caused by plasma containing active oxygen. Accordingly, important factor of the flame treatment is the activity or temperature of the plasma, and the content of oxygen. These two factors are affected by the ratio of gas to oxygen, and the highest energy density and a high activity of plasma can be obtained when the gas and oxygen are reacted just enough. In concrete, preferable mixing ratio of natural gas/air is from 1/6 to 1/10, more preferably from 1/7 to 1/9. The ratio of liquefied propane gas/air is preferably from 1/14 to 1/22, more preferably from 1/16 to 1/19. The ratio of city gas/ air is preferably from 1/2 to 1/8, more preferably from 1/3 to 1/7.

The heat amount of the flame treatment is preferably from 1 to 50 kcal/$m^2$, more preferably from 3 to 20 kcal/$m^2$. The distance between the point of the flame and the support is preferably from 3 to 7 cm, more preferably 4 to 6 cm. The preferable shape of the nozzle of burner includes a ribbon type of Fulin Burner Co., Ltd. in U.S.A., a multi-hole type of Wise Co., Ltd. in U.S.A., a ribbon type of Aerogen Co., Ltd. in G.B, a staggered multi-hole type of Kasuga Denki Co., Ltd. in Japan and a staggered multi-hole type of Koike Sanso Co.,Ltd. in Japan. The back-up roller for supporting the support in the flame treatment process is preferably a hollow roller. It is preferred that the temperature of the roller is maintained at from 20 to 50° C. during the treatment by cooling the roller with water flowing through the hollow.

The above-mentioned surface treatment is applyied to the support surface so that the atomic percentage of oxygen at the surface of the support is increased by 1.0 atomic % to 10 atomic %, preferably by 1.5 atomic % to 10 atomic %, compared with the atomic percentage of oxygen at the surface before the treatment.

The atomic percent of oxygen atom on the support surface before or after the surface treatment is measured by a X-ray photoelectron spectroscopic (XPS) surface analyser. The procedure for the measurement is as follows:

The XPS surface analyzer is set up at the following conditions.

Anode of X-ray generating bulb: Mg

X-ray output: 600 W

Photoelectron receiving angle: 30–60°

Resolution ability: 1.5 to 1.7 eV

The resolution ability is defined by a half value width of 3d5/2 peak the clean silver metal.

An adhesive tape is not used for fixing the sample. Any of XPS surface analyzer can be used without any limitation. In the example of this specification, ESCALUB-200R manufactured by VG Co., Ltd. is used. As to the analysis by X-ray photoelectron spectrum, "Surface Analysis, Fundamental and Application" edited by D. Briggsand M. P. Seah, tramslated by Hyomen Bussei Kenkyu kai, Publised by Agne-Shofusha, may be referred.

A qualitative analysis of element is carried out by wide scanning, then the spectrum of the element detected by the wide scanning is measured by narrow scanning. In the narrow scanning, the date are read at an interval of 0.2 eV. The spectrum of each element is calibrated with respect to the counter scale, and smoothed over five points of the measurement. The peak area intensity, cps*eV, is determined and calibrated by the sensitivity factor for obtaining the atomic percent of each of the element.

The subbing material usable in the subbing layer or the layer adjoining to the support according to the invention is not limited as far as one having a good layer forming property. For example, polyester, polyamide, polyurethane, a vinyl copolymer, a butadiene copolymer, an acryl copolymer, a vinylidene copolymer, an epoxy copolymer and gelatin are preferably usable. These materials can be used singly or in combination.

The water-soluble or water-dispersible polymer having the 2-oxazoline group according to the invention is further mixed with the foregoing subbing material. The amount of the water-soluble oxazoline group-containing polymer is preferably not less than 5% by weight, and that of the water-dispersible oxazoline group-containing polymer is preferably not less than 15% by weight. The adding amount of the water-dispersible oxazoline group-containing polymer is more preferably not less than 60% by weight. The water-dispersible oxazoline group-containing polymer can be used alone without the combination with the foregoing subbing material.

A matting agent, surfactant, inorganic particle, pH controlling agent may be added to the subbing layer together with the above-mentioned materials according to necessity. An electric conductive material may be added to the subbing layer so that the subbing layer has the function of a electric conductive layer.

The subbing layer according to the invention may be coated by a know method without any limitation. The subbing layer is usually coated on the support during the extrusion or before or after the stretching of the support.

Example of the information recording medium according to the invention using the foregoing support includes a silver halide photographic light-sensitive material, a magnetic recording medium, an electrophotographic material, and a thermal sensitive image forming material. Among them, the support according to the invention is preferably applied for the magnetic recording medium and a silver halide photographic light-sensitive material. The support according to the invention is also preferably applied to an information recording medium having both of a silver halide photographic layer and a magnetic recording layer. The silver halide photographic light-sensitive material comprises a silver halide emulsion layer, and may optionally have an assistance layer such as an interlayer, a protective layer, an antihalation layer, a backing layer and an antistatic layer. The magnetic recording medium has a magnetic recording layer, and may have an assistance layer such as a protective layer and an electric conductive layer.

It is preferred in the invention that the support is subjected to a heating treatment at a temperature of from 90° C. to 150° C. for 1 minute or more after coating of the subbing layer containing the 2-oxazoline group-containing polymer. The timing of the heat treatment is no specifically limited. For example, the treatment may be performed continuously after the coating of the subbing layer. The heat treatment may be also applied for the purpose of reducing the roll set curl.

In the invention, it is referred to provide an antistatic layer on a side of the support.

In the anti-static layer, almost anti-static agents and anti-static compositions effectively used in a silver halide photographic light-sensitive material are usable. Examples of the antistatic agent or composition include the followings: a styrene/sodium maleate copolymer described in Japanese Patent (JP) Nos. 47-28937 and 49-23828, a styrene/sodium vinylbenzyl-sulfonate copolymer described in JP O.P.I. No. 53-82876, an anionic anti-static agent such as a sodium styrenesulfonate polymer and its copolymer described in JP No. 48-23451, an ionen polymer such as a copolymer of triethylenediamine and xylidene dichloride described in JP O.P.I. Nos. 51-42535, 54-159222 and 55-7763, polymethacryloyldiethylmethylammonium methylsulfonate described in U.S. Pat. No. 2,882,157, a cross-linked copolymer particle having a quatenary ammonium group at the side chain thereof such as copolymer of [N,N,n-trimethyl-N-vinylbenzyl-ammonium chloride-co-divinylbenzene] described in JP No, 60-51693, and JP O.P.I. Nos. 61-223736 and 62-9346, a cationic anti-static gent such as an ionen cross-linked copolymer and a particle of copolymer having a ionen copolymer at the side chain thereof such as a cross-linking product of polyvinylbenzyl chloride and a polymer of triethylenediamine and xylidene dichloride having a terminal N atom described in JP O.P.I. No. 7-28194, a composition principally composed of alumina sol described in JP No. 57-12979, a fine particle of metal oxide such as ZnO, $SnO_2$, $TiO_2$, $Al_2O_3$, $In_2O_3$, $SiO_2$, MgO, BaO, $MoO_3$ or $ZiO_2$ described in JP O.P.I. No. 57-104931, a metal oxide anti-static agent such as $V_2O_5$ described in JP No. 55-5982, an anti-static agent of higher fatty alcohol phosphate, a poly(isothianaphthene) compound described in JP O.P.I. No. 2-252726, and an electric conductive high molecular compound having a conjugated double bond such as a poly (thiophene) compound described in JP O.P.I. Nos. 2-55770 and 2-308246.

Among the foregoing anti-static agent, those principally composed of a sodium styrenesulfonate copolymer and of a the metal oxide are preferred.

A metal magnetic powder, an iron oxide magnetic powder, a Co-doped iron oxide magnetic powder, a chromium dioxide magnetic powder and a barium ferrite magnetic powder are usable as the magnetic powder in the magnetic recording layer. The producing method of these magnetic powders have been known. The magnetic powder to be used in the information recording media of the invention is produced by the known method.

There is no limitation on the shape and size of the particle of the magnetic powder. The shape of the particle may be needle-like, rice grain-like, spherical, cubic and tabular. Among them needle-like or tabular one is preferred from the viewpoint of the electromagnetic conversion property. There is no limitation on the crystalline size and the specific surface area of the particle. The magnetic powder may be treated on the surface thereof. For example, one treated on the surface thereof by a material containing titanium, silicon, or aluminum or one treated by an organic material such as a carboxylic acid, a sulfonic acid, a sulfuric acid ester, a phosphoric acid, a phosphoric acid ester and a nitrogen-containing heterocyclic compound which are capable of adsorbing to the particle. The pH value of the magnetic powder is preferably within the range of from 5 to 10, although there is no limitation on the pH value.

With respect to the size of the magnetic particle, it is described in "The Properties and Application of the Extra Fine Particle Semitransparent Magnetic Recording Medium" in "Television vol. 20 No. 2", that there is a relation between the size and the transparency of the particle. For example, the light transparency of needle-like $\gamma$-$Fe_2O_3$ powder is raised when the particle size is made small.

U.S. Pat. No. 2,950,971 describes that a magnetic layer composed of a magnetic iron oxide dispersed in a binder is transparent to infrared rays. U.S. Pat. No. 4,279,945 describes that the transparency of the magnetic layer to He—Ne laser light of 632.8 nm is improved by reducing the particle sized when the concentration of magnetic particle in the magnetic layer is relatively high.

However, the light transparency in green and blue region not only in red region has to be high when the magnetic recording layer is provided in the image forming area of silver halide color photographic light-sensitive material.

Therefore, it is necessary to limit the coating amount of the magnetic particle and to make small the size of the particle.

The magnetic properties of the magnetic particle is degraded when the particle size is made smaller than a certain degree. Accordingly, the particle size is preferably to be small within the range where the sufficient magnetic property can be obtained. The coating amount of the magnetic particle is reduced within the range in which the sufficient magnetic property can be obtained since the magnetic property is degraded when the coating amount is excessively reduced.

The practical coating amount of the magnetic powder is preferably from 0.001 to 3 $g/m^2$, more preferably 0.01 to 1 $g/m^2$.

As the binder of the magnetic recording layer, a known resin usually used for magnetic recording medium such as a thermoplastic resin, a irradiation-curable resin, a heat-curable resin, another reactive resin and a mixture thereof are usable.

A thermoplastic resin is preferably one having a glass transition point Tg of from −40° to 150°, more preferably from 60° C. to 120°, and a weight average molecular weight of from 10,000 to 300,000, more preferably from 50,000 to 200,000.

In the invention, the binder of the magnetic recording layer is preferably one principally composed of a cellulose ester, in concrete, a cellulose acetate such as cellulose diacetate, cellulose acetate-butylate, and cellulose acetate-propionate; a cellulose nitrate; a cellulose sulfate and a mixture thereof. Among them, cellulose diacetate, cellulose acetate-butylate, cellulose acetate-propionate, particularly cellulose diacetate, are preferred.

The binder may be hardened. Usable hardener includes an aldehyde compound, a ketone compound, a compound having a reactive halogen, a compound having a reactive olefin group, N-hydroxymethylphthalimide, an N-methylol compound, an isocyanate compound, an azilidine compound, an acid derivative compound, an epoxy compound, a halognecarboxyaldehyde compound and an inorganic hardener.

The hardener is usually in an amount of from 0.01 to 30% by weight, preferably from 0.05 to 20% by weight.

The magnetic powder is dispersed in the binder to prepare a coating liquid of magnetic layer, a solvent may be used according to necessity. A ball mill, a homomixer, or sand mill can be used for dispersing the magnetic powder. It is preferable to individually disperse the magnetic particle one by one without destruction of the particle.

To form an optically transparent magnetic layer, the binder is preferably used in an amount of from 1 to 20 parts, more preferably from 2 to 15 parts, by weight per part of the magnetic powder. The solvent is used in an amount necessary for easily coating the coating liquid.

The thickness of the magnetic recording layer is preferably from 0.1 to 10 $\mu$m, more preferably from 0.5 to 3 $\mu$m.

Various additives such as a lubricant and an anti-static agent may be added to the coating solution of the magnetic recording layer to give a slidability, anti-static ability, adhesion preventing ability and anti-abrasion ability to the magnetic recording layer. Moreover, a plasticizer to give the softness, a dispersing agent to assist the dispersion of the magnetic powder in the coating solution, and abrasive to prevent the blocking of magnetic head may be added to the coating solution.

A protective layer may be provided as the outermost layer adjoining to the magnetic recording layer to raise the resistivity to scratch. A compound usually known as a lubricant can be used for giving the scratch resistivity, and a higher fatty acid ester is preferred. When the magnetic recording layer is provided in a shape of stripe, a transparent polymer layer containing no magnetic powder may be provided on the magnetic recording layer to remove the difference in level caused by the magnetic recording layer. In such the case, the transparent polymer layer may have various functions.

The silver halide emulsion to be used in the light-sensitive material according to the invention can be prepared by the methods described in, for example, Research Disclosure, herein after referred to RD, No. 17643, p.p. 22–23, I "Emulsion preparation and types", December 1978, RD No. 18716, p. 648, P. Glafkides, "Chimique et Phisique Photographique" Paul Montel, 1967, G. F. Duffin, "Photographic Emulsion Chemistry", Focal Press, V. L. Zelikman "Making and Coating Photographic Emulsion" Focal Press 1964.

A monodisperse emulsion described in U.S. Pat. Nos. 3,574,628 and 3,665,394, and BP No. 1,413,748 is preferably usable.

The silver halide emulsion may be subjected to a physical ripening, a chemical ripening and optical sensitization. Additives to be used in such the process are described in RD Nos. 17643, 18716, and 308119.

When the light-sensitive material according to the invention is a color photographic light-sensitive material, additives usable in the color light-sensitive material are also described in the foregoing Research Disclosure. Various kinds of coupler can be used in the color light-sensitive material, examples of which are described in RD Nos. 17643 and 308119.

These additives can be added to the emulsion layer according to the dispersion method described in RD No. 308119, p. 1007, XIV.

A assistance layer such as a filter layer and an interlayer m ay be provided in the color light-sensitive material, which is described in RD No. 308119, II-K.

The color light-sensitive material according to the invention may have various layer constitutions such as an ordinary layer order constitution, a reverse layer order constitution and an unit constitution, which are described in RD No. 308119, VII-K.

Known developing agents, for example, those described in "The Theory of The Photographic Process" Forth Edition, p.p. 291–334, and "Journal of the American Chemical Society" vol. 73, No. 3, p. 100, 1951, may be used for developing the light-sensitive material according to the invention. The color light-sensitive material may be processed by an ordinary method described in RD No. 17643, p.p. 28–29, RD No. 18716, p. 615 and RD No. 308119 XIX.

EXAMPLES

Example 1

Preparation of support

To 100 parts by weight of dimethyl 2,6-naphthalene dicarboxylate and 60 parts by weight of ethylene glycol, 0.1 parts by weight of hydrated calcium acetate was added as a catalyst, and an ester exchange reaction was carried out. To the product, 0.05 parts by weight of antimony trioxide and 0.03 parts by weight of trimethyl phosphate were added. Then the temperature and the atmosphere pressure were gradually changed, and polymerization was carried out under a condition of 290° C. and 0.05 mmHg. Thus polyethylene 2,6-naphthalate having an intrinsic viscosity of 0.60 was obtained.

The obtained polymer was dried at 150° C. for 8 hours. Then the polymer was molten at 300° C. and extruded through a T-die on a cooling drum cooled at 50° C. while applying static electricity for contacting the polymer with the drum. Thus the polymer was cooled and solidified to form a non-stretched sheet. The non-stretched sheet is lengthwise stretched by 3.3 times at 135° C. by a roller type lengthwise stretching machine.

The lengthwise stretched film was widthwise stretched by a tenter type widthwise stretching machine by 50% in the first stretching zone at 145° C. and further stretched in the second stretching zone at 155° C. as that the stretching ratio was 3.3 times in total. Then the stretched sheet was subjected to a heat treatment at 100° C. for 2 seconds, and was fixed in the first fixing zone at 200° C. for 5 seconds and in the second fixing zone at 240° C. for 15 seconds. Further, the sheet was widthwise slackened by 5% while cooling by the room temperature spending 30 seconds. Thus a polyethylene naphthalate (PEN) film having a thickness of 85 μm was obtained.

The film was winded up on a core made by stainless steel and subjected to a heat treatment at 110° C. for 48 hours for preparing a support.

Besides, a polyethylene terephthalate (PET) film having a thickness of 90 μm was prepared.

A surface treatment such as corona discharge treatment was applied on one side of thus obtained support. The intensity of the surface treatment is listed in Table 1. A solution composed of a subbing material and a cross-linking agent in a ratio of the described in Table 1 was prepared, and the following compound UL-1 was added in an amount so that the ratio of UL-1 was 1% by weight of the total solid composition. The solution was coated and dried on the treated surface of the support so that the dried thickness was 0.2 μm as the subbing layer containing the polymer having 2-oxazoline group according to the invention.

UL-1

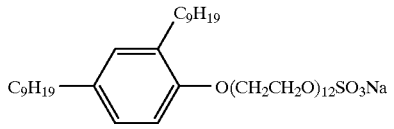

The surface of the coated subbing layer was subjected to a corona discharge of 12 W/m$^2$/min. On the surface, an electric conductive layer coating solution A-1 was coated as a constituting layer of magnetic recording medium and dried so that the dried thickness was 0.2 μm. Drying was carried out at 90° C. for 10 seconds. The support was further subjected to a heating treatment under the conditions listed in Table 1. Thus Samples 101 through 119 were prepared.

On the other hand, Sample 120 was prepared in the same manner as in Sample 101 except that a glow discharge treatment was applied in place of the first corona discharge treatment in sample 101. The treatment was carried out under conditions of a vacuum of 0.1 Torr, a partial pressure of $O_2$ of 70%, a discharge frequency of 20 kHz, an output of 2500 W, and a treating intensity of 0.5 KV.A.min./m$^2$.

Sample 121 was prepared in the same manner as in sample 101 except that an ultraviolet treatment was applied in place of the first corona discharge in Sample 101. The ultraviolet treatment was performed at 110° C. for 2 minutes by irradiating the support by ultraviolet rays having a principal wavelength of 365 nm generated from a 1 kW cylindrical quartz high pressure mercury lamp having a width of 50 cm and an arc length of 30 cm which was arranged in parallel with the support with a distance of 10 cm.

Further Sample 122 was prepared in the same manner as in Sample 101 except that a flame treatment was applied in place of the first corona discharge treatment in Sample 101. The flame treatment was carried out under conditions of a mixing ratio of liquidized propane gas/air of 1/17, a heat amount of flame treatment of 15 kcal/$m^2$.

Subbing material

B-1: A latex of a copolymer of 60 parts by weight of butyl acrylate, 30 parts by weight of styrene and 10 parts by weight of acrylic acid. The solid content of the latex was 30%.

B-2: A latex of a copolymer of 40 parts by weight of butyl acrylate, 20 parts by weight of styrene and 40 parts by weight of glycidyl methacrylate. The solid content of the latex was 30%.

B-3: Gelatin

B-4: An aqueous dispersion A which was prepared by the following method. Sixty mole percent of dimethyl terephthalate, 30 mole % of dimethyl isophthalate, 10 mole % of sodium salt of dimethyl 5-sulfoisophthalate, as dicarboxylic acid components and 50 mole % of ethylene glycol and 50 mole % of diethylene glycol, as glycol components, were copolymerized by an ordinary method. Thus obtained copolymer A was stirred for 3 hours at 95° C. in hot water to prepare an aqueous dispersion A having a solid content of 15% by weight.

Cross-linking agent

H-1: A comparative compound having the following structure.

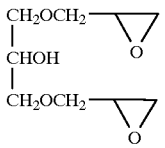

H-2: Epocros K2020E (Nippon Shokubai Co., Ltd.) relating to the invention, a water-dispersible polymer having a 2-oxazoline group according to the invention H-3: Epocros WS300 (Nippon Shokubai Co., Ltd.) relating to the invention, a water-soluble polymer having a 2-oxazoline group according to the invention H-4: Epocros WS500 (Nippon Shokubai Co., Ltd.) relating to the invention, a water-soluble polymer having a 2-oxazoline group according to the invention

| <Electric conductive layer coating solution A-1> | |
|---|---|
| Combined fine particle of tin oxide and antimony oxide (Average diameter: 0.2 μm) | 44 g |
| Above-mentioned Aqueous dispersion A | 109 g |
| Compound UL-1 | 0.4 g |
| Water to make | 1000 ml |

Thus obtained samples were evaluated by the following methods. Results are listed in Table 1.

Adhesiveness of the support with the adjoining subbing layer

Three pieces of specimen were taken from each of the samples, and one of them was stood for 12 hours at a temperature of 23° C. and a relative humidity of 55%. Another one specimen was immersed in the following color developing solution adjusted at 38° C. for 3 minutes 15 seconds and washed for 3 minutes in a running water. The specimen was dried and stood for 12 hours at a temperature of 23° C. and a relative humidity of 55%. Then the coated surface of the foregoing specimens were each scratched at a speed of 10 mm/second by a sapphire stylus having a point radius of 150 μm which a was perpendicularly contacted to the surface. The load applying on the stylus is continuously increased from 20 g to 120 g during the scratching. The third specimen was scratched in a wetted state just after treatment for 3 minutes 15 seconds by the color developing solution. The specimens were visually observed through an optical microscope having a magnitude of 100, and the load necessary for peeling off the subbing layer from the support was measured. A larger value of the loaded weight indicates a higher adhesiveness and a sample having such the value of not less than 70 is acceptable for practical use, and a sample having the value of 100 or more is preferred.

| <Color developing solution> | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl)aniline sulfate | 4.5 g |
| Diethylenetriaminepentaacetic acid | 3.0 g |
| Potassium hydroxide | 1.2 g |
| Water to make | 1 l |

The pH of the solution was adjusted to 10.06 by using potassium hydroxide of 20% sulfuric acid.

TABLE 1

| Sample No. | Support | Corona discharge W/$m^2$/min | Subbing material Kind | Subbing material Amount wt-% | Cross-linking agent Kind | Cross-linking agent Amount wt-% | Heat treatment condition ° C. | Heat treatment condition Minute | Increasing of oxygen atomic % | Adhesiveness Before processing | Adhesiveness During processing | Adhesiveness After processing |
|---|---|---|---|---|---|---|---|---|---|---|---|---|
| 101c | PET | None | B-1 | 90 | H-1 | 10 | 130 | 2 | — | 28 | 21 | 24 |
| 102c | PET | 12 | B-1 | 90 | H-1 | 10 | 130 | 2 | 1.8 | 41 | 32 | 37 |
| 103c | PET | None | B-1 | 90 | H-4 | 10 | 130 | 2 | — | 42 | 39 | 40 |
| 104 | PET | 12 | B-1 | 90 | H-4 | 10 | 130 | 2 | 1.8 | 116 | 108 | 112 |
| 105c | PEN | None | B-2 | 30 | H-2 | 70 | 115 | 2 | — | 38 | 28 | 35 |
| 106 | PEN | 6 | B-2 | 30 | H-2 | 70 | 115 | 2 | 1.2 | 78 | 71 | 72 |
| 107 | PEN | 12 | B-2 | 30 | H-2 | 70 | 115 | 2 | 2.5 | 118 | 114 | 115 |
| 108 | PEN | 16 | B-2 | 30 | H-2 | 70 | 115 | 2 | 3.4 | 120 | 120 | 120 |
| 109 | PEN | 12 | B-2 | 96 | H-4 | 4 | 115 | 2 | 2.5 | 73 | 70 | 71 |

TABLE 1-continued

| Sample No. | Support | Corona discharge W/m²/min | Subbing material Kind | Subbing material Amount wt-% | Cross-linking agent Kind | Cross-linking agent Amount wt-% | Heat treatment condition ° C. | Heat treatment condition Minute | Increasing of oxygen atomic % | Adhesiveness Before processing | Adhesiveness During processing | Adhesiveness After processing |
|---|---|---|---|---|---|---|---|---|---|---|---|---|
| 110 | PEN | 12 | B-2 | 93 | H-4 | 7 | 115 | 2 | 2.5 | 105 | 101 | 103 |
| 111 | PEN | 12 | B-2 | 85 | H-2 | 15 | 115 | 2 | 2.5 | 78 | 70 | 71 |
| 112 | PEN | 12 | B-2 | 40 | H-2 | 60 | 115 | 2 | 2.5 | 110 | 103 | 107 |
| 113 | PEN | 12 | None | - | H-2 | 100 | 115 | 2 | 2.5 | 120 | 120 | 120 |
| 114 | PEN | 12 | B-2 | 30 | H-2 | 70 | 70 | 2 | 2.5 | 85 | 77 | 80 |
| 115 | PEN | 12 | B-2 | 30 | H-2 | 70 | 90 | 2 | 2.5 | 112 | 107 | 109 |
| 116 | PEN | 12 | B-2 | 30 | H-2 | 70 | 115 | 1 | 2.5 | 108 | 101 | 104 |
| 117 | PEN | 12 | B-2 | 80 | H-3 | 20 | 115 | 2 | 2.5 | 120 | 120 | 120 |
| 118 | PEN | 12 | B-3 | 80 | H-4 | 20 | 115 | 2 | 2.5 | 118 | 101 | 115 |
| 119 | PEN | 12 | B-4 | 80 | H-3 | 20 | 115 | 2 | 2.5 | 120 | 115 | 120 |
| 120 | PEN | Glow | B-2 | 30 | H-2 | 70 | 115 | 2 | 3.7 | 120 | 120 | 120 |
| 121 | PEN | UV | B-2 | 80 | H-4 | 20 | 115 | 2 | 1.6 | 105 | 101 | 100 |
| 122 | PEN | Flame | B-2 | 30 | H-2 | 70 | 115 | 2 | 1.8 | 108 | 104 | 105 |

In the table, "c" attached to the sample number indicates that the sample is a comparative sample.

It is understood from the results shown in Table 1 that the layer containg the polymer having 2-oxazoline group is considerably raised in the adhesiveness with the support by the surface treatment compared with the layer containing the usual cross-linking agent. The samples according to the invention are excellent in the adhesiveness between the support and the subbing layer adjoining to the support at any time of before, during and after the processing. The samples containing the water-soluble polymer having 2-oxazoline group in an amount of 5% by weight or more, the samples containing the water-dispersible polymer having 2-oxazoline group in an amount of 60% by weight or more, the samples heat treated at a temperature of 90° C. or more and for a time of 1 minute or more, and the samples in which the atomic percentage oxygen atom at the surface is increased by 1.0 atomic-% or more after the surface treatment, are particularly excellent in the adhesiveness.

Example 2

A magnetic recording layer coating liquid M-1 was coated on the electric conductive layer of each of the samples so as to form a magnetic recording layer having a dry thickness of 0.8 μm. Furthermore, a lubricant layer coating liquid O-1 was coated on the magnetic recording layer to form a lubricant layer having a thickness of 0.2 μm. Thus Samples 201 through 222 were prepared.

| <Magnetic recording layer coating liquid M-1> | |
|---|---|
| Co-adhered γ-$Fe_2O_3$ (Coersive force: 900 Oe, specific surface area: 40 m²/g, length of minor axis: 0.03 mm) | 4.8 parts by weight |
| Cellulose diacetate (Acetalized degree: 55%, Weight average molecular weight: 180,000) | 100 parts by weight |
| Tolylenediisocyanate | 17.0 parts by weight |
| Abrassive particle ($Al_2O_3$, ratio of major axis to minor axis: 1.1, Central particle diameter: 0.8 μm) | 1.2 parts by weight |
| Acetone | 1130.0 parts by weight |
| Cyclohexanone | 280.0 parts by weight |

The above materials were mixed by a dissolver for 1 hour and dispersed by a sand mill for 2 hours to form a dispersion.

| <Coating liquid of lubricant layer O-1> | |
|---|---|
| Carnauba wax | 7 g |
| Toluene | 700 g |
| Methyl ethyl ketone | 300 g |

The resistivity of the sample to scratch caused by passing on a magnetic head, hereinafter referred to a resistivity to magnetic head scratch, was determined by the following procedure. Results of the evaluation are shown in Table 2.

Evaluation of the resistivity to magnetic head scratch

A surface property tester HEIDONN-14DR, manufactured by Shinto Kagaku Co., Ltd. The samples was repeatedly rubbed for 100 times by a rubbing head at a speed of 100 mm/second while applying a load of 300 g to the head. The condition of the scratch formed after rubbing was visually evaluated and classified according to the following norm.

A: No scratch was observed.

B: A light scratch was observed.

C: A serious scratch was observed.

TABLE 2

| Sample No. | Support | Corona discharge W/m²/min | Subbing material Kind | Subbing material Amount wt-% | Cross-linking agent Kind | Cross-linking agent Amount wt-% | Heat treatment condition ° C. | Heat treatment condition Minute | Increasing of oxygen atomic % | Resistivity to magnetic head scratch |
|---|---|---|---|---|---|---|---|---|---|---|
| 201c | PET | None | B-1 | 90 | H-1 | 10 | 130 | 2 | — | C |
| 202c | PET | 12 | B-1 | 90 | H-1 | 10 | 130 | 2 | 1.8 | C |
| 203c | PET | None | B-1 | 90 | H-4 | 10 | 130 | 2 | — | C |
| 204 | PET | 12 | B-1 | 90 | H-4 | 10 | 130 | 2 | 1.8 | A |
| 205c | PEN | None | B-2 | 30 | H-2 | 70 | 115 | 2 | — | C |
| 206 | PEN | 6 | B-2 | 30 | H-2 | 70 | 115 | 2 | 1.2 | B |
| 207 | PEN | 12 | B-2 | 30 | H-2 | 70 | 115 | 2 | 2.5 | A |
| 208 | PEN | 16 | B-2 | 30 | H-2 | 70 | 115 | 2 | 3.4 | A |
| 209 | PEN | 12 | B-2 | 96 | H-4 | 4 | 115 | 2 | 2.5 | B |
| 210 | PEN | 12 | B-2 | 93 | H-4 | 7 | 115 | 2 | 2.5 | A |
| 211 | PEN | 12 | B-2 | 85 | H-2 | 15 | 115 | 2 | 2.5 | B |
| 212 | PEN | 12 | B-2 | 40 | H-2 | 60 | 115 | 2 | 2.5 | A |
| 213 | PEN | 12 | None | — | H-2 | 100 | 115 | 2 | 2.5 | A |
| 214 | PEN | 12 | B-2 | 30 | H-2 | 70 | 70 | 2 | 2.5 | B |
| 215 | PEN | 12 | B-2 | 30 | H-2 | 70 | 90 | 2 | 2.5 | A |
| 216 | PEN | 12 | B-2 | 30 | H-2 | 70 | 115 | 1 | 2.5 | A |
| 217 | PEN | 12 | B-2 | 80 | H-3 | 20 | 115 | 2 | 2.5 | A |
| 218 | PEN | 12 | B-3 | 80 | H-4 | 20 | 115 | 2 | 2.5 | A |
| 219 | PEN | 12 | B-4 | 80 | H-3 | 20 | 115 | 2 | 2.5 | A |
| 220 | PEN | Glow | B-2 | 30 | H-2 | 70 | 115 | 2 | 3.7 | A |
| 221 | PEN | UV | B-2 | 80 | H-4 | 20 | 115 | 2 | 1.6 | A |
| 222 | PEN | Flame | B-2 | 30 | H-2 | 70 | 115 | 2 | 1.8 | A |

It was confirmed by observation by a canning electron microscope that the scratch formed on the sample was caused by peeling at the interface of the support and the layer adjoining to the support.

The samples containing the water-soluble polymer having the 2-oxazoline group in an amount of 5% by weight or more, the samples containing the water-dispersible polymer having the 2-oxazoline group in an amount of 60% by weight or more, the samples heat treated at a temperature of 90° C. or more and for a time of 1 minute or more, and the samples in which the atomic percentage of oxygen atom at the surface is increased by 1.0 atomic-% or more after the surface treatment, are particularly excellent in the adhesiveness.

Example 3

Supports for Samples 301 through 322 were prepared each provided a subbing layer the same as in Example 1 on both sides thereof. On the subbing layer of one side of the support, an electric conductive layer the same as in Example 1 was coated as a constituting layer of the magnetic recording layer. Besides the subbing layer on the other side of the support was subjected to corona discharge treatment of 12 W/m²/minute and the following under-coating solution A-2 was coated so that the thickness of the dried layer was 0.1 μm. Then the support was subjected to a heat treatment the same as in Example 1.

On the electric conductive layer, a magnetic recording layer and a lubricant layer each the same as in Example 2 were provided. On the other side of the support, photographic constituting layers the same as those of Konica Color Film LV400, manufactured by Konica Corporation, were provided.

Thus Sample 301 to 322 were prepared.

| Under-coating Solution A-2 | |
|---|---|
| Gelatin | 10 g |
| Compound UL-1 | 0.2 g |
| Compound UL-2 | 0.2 g |
| Silica particles, average size: 3 μm | 0.1 g |
| Cross linking agent H-5 | 1 g |
| Water to make | 1000 ml |

UL-2

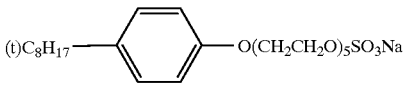

H-5

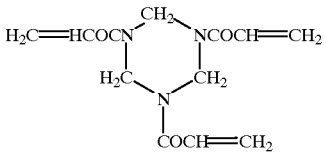

The samples were processed by the following processing. Then the resistivity to magnetic head scratch after processing of the magnetic recording layer face was evaluated in the same manner as in Example 2.

| <Processing conditions> | |
|---|---|
| Color development | 3 min. 15 sec. 38.0° ± 0.1° C. |
| Bleaching | 6 min. 30 sec. 38.0° ± 3.0° C. |
| Washing | 3 min. 15 sec. 24° C. – 41° C. |
| Fixing | 6 min. 30 sec. 38.0° ± 3.0° C. |
| Washing | 3 min. 15 sec. 24° C. – 41° C. |
| Stabilizing | 3 min. 15 sec. 38.0° ± 3.0° C. |
| Drying | Not more than 50° C. |

Composition of the processing solutions are shown below.

| <Color developing solution> | |
|---|---|
| 4-amino-3-methyl-N-ethyl-N-(β-hydroxyethyl)aniline sulfate | 4.75 g |
| Sodium sulfite anhydride | 4.25 g |
| Hydroxyl amine 1/2 sulfate | 2.0 g |
| Potassium carbonate anhydrate | 37.5 g |
| Sodium bromide | 1.3 g |
| Sodium nitrylotriacetate monohydrate | 2.5 g |
| Potassium hydroxide | 1.0 g |
| Water to make 11, pH = 10.1 | |

| <Bleaching solution> | |
|---|---|
| Ferric (III) ammonium ethylenediamine tetraacetate | 100.0 g |
| Diammonium ethylenediaminetetraacetate | 10.0 g |
| Ammonium bromide | 150.0 g |
| Glacial acetic acid | 10.0 g |
| Water to make | 1 l |
| The pH value is adjusted to 6.0 by ammonia water. | |

| <Fixing solution> | |
|---|---|
| Ammonium thiosulfate | 175.0 g |
| Sodium sulfite anhydrate | 8.5 g |
| Sodium metasulfite | 2.3 g |
| Water to make | 1 l |
| The pH value is adjusted to 6.0 by acetic acid. | |

| <Stabilizing solution> | |
|---|---|
| Formalin (37% aqueous solution) | 1.5 ml |
| Koniducks, manufactured by Konica Corp. | 7.5 ml |
| Water to make | 1 l |

The adhesiveness between the support and the subbing layer of the emulsion coated side in each of the samples before, during and after processing was evaluated by the following method. Results of the evaluation are shown in Table 3.

Evaluation of the adhesiveness between the support and the subbing layer on the emulsion coated side Three pieces of specimen were taken from each of the samples. One of the specimen was stood for 12 hours at a temperature of 23° C. and a relative humidity of 55%. Another one of the specimen was processed under the foregoing processing conditions and stood for 12 hours at a temperature of 23° C. and a relative humidity of 55%. Then the emulsion coated surface of the specimens were each scratched at a speed of 10 mm/second by a sapphire stylus having a point radius of 25 μm which a was perpendicularly contacted to the surface. The load applied on the stylus is continuously increased from 0 to 120 g while scratching. The third specimen was scratched in a wetted state just after treatment for 3 minutes 15 seconds by the color developing solution. The specimens were visually observed through an optical microscope having a magnitude of 100, and the load necessary for peeling off the subbing layer from the support was measured. A larger value of this load indicates a higher adhesiveness. The test was carried out with respect to all the samples.

TABLE 3

| Sample No. | Support | Corona discharge W/m²/min | Subbing material Kind | Subbing material Amount wt-% | Cross-linking agent Kind | Cross-linking agent Amount wt-% | Heat treatment condition ° C. | Heat treatment condition Minute | Increasing of oxygen atomic % | Ahdesiveness Before processing | Ahdesiveness During processing | Ahdesiveness After processing | Resistivity to magnetic head scratch |
|---|---|---|---|---|---|---|---|---|---|---|---|---|---|
| 301c | PET | None | B-1 | 90 | H-1 | 10 | 130 | 2 | — | 18 | 10 | 16 | C |
| 302c | PET | 12 | B-1 | 90 | H-1 | 10 | 130 | 2 | 1.8 | 25 | 14 | 21 | C |
| 303c | PET | None | B-1 | 90 | H-4 | 10 | 130 | 2 | — | 28 | 23 | 25 | C |
| 304 | PET | 12 | B-1 | 90 | H-4 | 10 | 130 | 2 | 1.8 | 79 | 68 | 72 | A |
| 305c | PEN | None | B-2 | 30 | H-2 | 70 | 115 | 2 | — | 23 | 18 | 19 | C |
| 306 | PEN | 6 | B-2 | 30 | H-2 | 70 | 115 | 2 | 1.2 | 68 | 60 | 64 | B |
| 307 | PEN | 12 | B-2 | 30 | H-2 | 70 | 115 | 2 | 2.5 | 80 | 67 | 74 | A |
| 308 | PEN | 16 | B-2 | 30 | H-2 | 70 | 115 | 2 | 3.4 | 88 | 72 | 80 | A |
| 309 | PEN | 12 | B-2 | 96 | H-4 | 4 | 115 | 2 | 2.5 | 63 | 57 | 60 | B |
| 310 | PEN | 12 | B-2 | 93 | H-4 | 7 | 115 | 2 | 2.5 | 74 | 65 | 70 | A |
| 311 | PEN | 12 | B-2 | 85 | H-2 | 15 | 115 | 2 | 3.7 | 65 | 58 | 62 | B |
| 312 | PEN | 12 | B-2 | 40 | H-2 | 60 | 115 | 2 | 1.6 | 77 | 67 | 75 | A |
| 313 | PEN | 12 | None | — | H-2 | 100 | 115 | 2 | 1.8 | 87 | 75 | 81 | A |
| 314 | PEN | 12 | B-2 | 30 | H-2 | 70 | 70 | 2 | 2.5 | 68 | 61 | 66 | B |
| 315 | PEN | 12 | B-2 | 30 | H-2 | 70 | 90 | 2 | 2.5 | 81 | 74 | 78 | A |
| 316 | PEN | 12 | B-2 | 30 | H-2 | 70 | 115 | 1 | 2.5 | 84 | 73 | 80 | A |
| 317 | PEN | 12 | B-2 | 80 | H-3 | 20 | 115 | 2 | 2.5 | 88 | 70 | 81 | A |
| 318 | PEN | 12 | B-3 | 80 | H-4 | 20 | 115 | 2 | 2.5 | 77 | 60 | 71 | A |
| 319 | PEN | 12 | B-4 | 80 | H-3 | 20 | 115 | 2 | 2.5 | 83 | 77 | 80 | A |
| 320 | PEN | Glow | B-2 | 30 | H-2 | 70 | 115 | 2 | 3.7 | 86 | 78 | 82 | A |
| 321 | PEN | UV | B-2 | 80 | H-4 | 20 | 115 | 2 | 1.6 | 69 | 65 | 67 | A |
| 322 | PEN | Flame | B-2 | 30 | H-2 | 70 | 115 | 2 | 1.8 | 72 | 68 | 70 | A |

The results in Table 3 show that the samples of the invention are excellent in the adhesiveness between the support and the subbing layer adjoining to the subbing layer on the emulsion coated side, before, during and after the processing. The magnetic recording layer coated side of the samples of the invention are also excellent in the resistivity to magnetic head scratch. The samples containing the water-soluble polymer having the 2-oxazoline group in an amount of 5% by weight or more, the samples containing the water-dispersible polymer having the 2-oxazoline group in an amount of 60% by weight or more, the samples heat treated at a temperature of 90° C. or more and for a time of 1 minute or more, and the samples in which the atomic percentage of oxygen atom at the surface is increased by 1.0 atomic-% or more after the surface treatment, are particularly excellent in the adhesiveness.

What is claimed is:

1. A method for producing an information recording medium comprising the steps of applying a surface treatment on a surface of a film support so that the atomic percentage of oxygen at said surface is increased by 1.0 atomic-% to 10 atomic-% compared to the atomic percentage of oxygen at said surface before treatment, providing a subbing layer comprising a water-soluble or water-dispersible polymer having a 2-oxazoline group represented by Formula A on said treated surface of the film support so that the subbing layer is directly adjoined to said surface, and providing an information recording layer on said subbing layer, Formula A

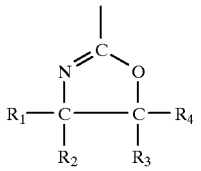

wherein $R_1$, $R_2$, $R_3$ and $R_4$ are each independently a hydrogen atom, a halogen atom, an alkyl group, an aralkyl group, a phenyl group.

2. The method of claim 1, wherein said surface treatment is applied to the support so that the atomic percentage of oxygen at said surface is increased by 1.5 atomic-% to 10 atomic-% compared to the atomic percentage of oxygen at said surface before treatment.

3. The method of claim 1, wherein said film support is principally comprising polyethylene terephthalate or polyethylene naphthalate.

4. The method of claim 1, wherein said surface treatment is a corona discharge treatment, a glow discharge treatment, an ultraviolet irradiation treatment or a flame treatment.

5. The method of claim 4, wherein the amount of corona discharge in said corona discharge treatment is from 0.001 KV.A.min./$m^2$ to 5 kV.A.min./$m^2$.

6. The method of claim 4, wherein the amount of glow discharge in said glow discharge treatment is from 0.01 KV.A.min./$m^2$ to 5 KV.A.min./$m^2$.

7. The method of claim 4, wherein the amount of ultraviolet irradiation in said ultraviolet irradiation treatment is from 20 mJ/$cm^2$ to 10,000 mJ/$cm^2$ by ultraviolet ray having a principal wavelength of 365 nm.

8. The method of claim 4, wherein the amount of ultraviolet irradiation in said ultraviolet irradiation treatment is from 100 mJ/$cm^2$ to 100,000 mJ/$cm^2$ by ultraviolet ray having a principal wavelength of 254 nm.

9. The method of claim 4, wherein the amount of heat in said flame treatment is from 1 to 50 kcal/$m^2$.

10. The method of claim 1, wherein said subbing layer contains said water-soluble polymer having said 2-oxazoline group in an amount of not less than 5% by weight.

11. The method of claim 1, wherein said subbing layer contains said water-dispersible polymer having said 2-oxazoline group in an amount of not less than 15% by weight.

12. The method of claim 1, wherein said subbing layer contains said water-dispersible polymer having said 2-oxazoline group in an amount of not less than 60% by weight.

13. The method of claim 1, wherein said steps further comprising the step of heating the film support at a temperature of from 90° C. to 150° C. for a time of not less than 1 minutes after providing said subbing layer.

14. The method of claim 1, wherein said information recording layer is a magnetic recording layer.

15. The method of claim 1, wherein said information recording layer is a silver halide photographic light-sensitive layer.

16. The method of claim 1, wherein said surface treatment and said subbing layer are provided on both sides of the film support and said information recording layer provided on one of the sides is a magnetic recording layer and said information recording layer provided on the other side of the suport is a silver halide photographic light-sensitive layer.

* * * * *